United States Patent [19]

Takeda

[11] 4,306,523

[45] Dec. 22, 1981

[54] AIR-FUEL RATIO CONTROL APPARATUS OF AN INTERNAL COMBUSTION ENGINE

[75] Inventor: Keisou Takeda, Susono, Japan

[73] Assignee: Toyota Jidosha Kogyo Kabushiki Kaisha, Toyota, Japan

[21] Appl. No.: 33,432

[22] Filed: Apr. 26, 1979

[30] Foreign Application Priority Data

May 1, 1978 [JP] Japan ..... 53/50732

[51] Int. Cl.[3] ..... F02M 23/04; F02D 5/02

[52] U.S. Cl. ..... 123/440; 123/437; 123/438; 123/489

[58] Field of Search ..... 123/119 EC, 32 EE; 60/276, 285; 123/437, 438, 440, 489

[56] References Cited

U.S. PATENT DOCUMENTS

| | | | |
|---|---|---|---|
| 4,029,061 | 6/1977 | Asano | 123/32 EE |
| 4,073,274 | 2/1978 | Saito | 60/285 |
| 4,119,074 | 10/1978 | Masaki et al. | 60/276 |
| 4,167,924 | 9/1979 | Carlson et al. | 123/119 EC |
| 4,173,956 | 11/1979 | Ikeura et al. | 60/276 |

*Primary Examiner*—Raymond A. Nelli

*Attorney, Agent, or Firm*—Kenyon & Kenyon

[57] ABSTRACT

An air-fuel ratio control apparatus of an internal combustion engine controls the change in the amount of fuel discharged into an intake passage downstream of a throttle valve of the engine more smoothly in accordance with the change in the amount of fuel discharged into the intake passage upstream of the throttle valve. Thus, the air-fuel ratio of the air-fuel mixture fed into the cylinder of the engine is changed smoothly without causing a surging phenomenon to occur in the engine.

5 Claims, 6 Drawing Figures

AIR-FUEL RATIO CONTROL APPARATUS OF AN INTERNAL COMBUSTION ENGINE

BACKGROUND OF THE INVENTION

The present invention relates to an air-fuel ratio control apparatus of an internal combustion engine and more particularly to an air-fuel ratio control apparatus having a closed feedback loop.

Generally, an internal combustion engine with a carburetor is equipped with a main fuel supply system for supplying fuel to a cylinder via a main discharge nozzle disposed on the venturi in an intake passage when a throttle valve is opened, and with a slow fuel supply system for supplying fuel to the cylinder via an idle port and/or a slow port in the intake passage when the throttle valve is closed or nearly closed. In such an internal combustion engine, a conventional air-fuel ratio control apparatus controls the amount of fuel to be supplied from both the main fuel supply system and the slow fuel supply system by using the same manipulated variable corresponding to a change in a detected signal from an air-fuel ratio sensor which is, for example, an oxygen concentration sensor disposed in the exhaust system for detecting the concentration of the oxygen component in the exhaust gas.

However, in the case where the air-fuel ratio condition of the engine is controlled according to conventional techniques, the air-fuel ratio of the air fuel mixture fed into the cylinder is suddenly changed in response to a change in the feedback control signal which in turn causes a surging phenomenon of the engine to occur. As a result, according to the conventional techniques for controlling the air-fuel ratio, the driving condition of the engine becomes extremely jerky.

The cause of the occurrence of the above-mentioned undesirable phenomenon is described hereinafter. In both the main fuel supply system and the slow fuel supply system, the amount of fuel to be fed into the cylinder is controlled in the same proportion in accordance with the feedback control signal from the air-fuel ratio sensor. Therefore, the amount of fuel fed from the respective system into the cylinder changes in the same proportion, corresponding to the change in the feedback control signal. Since the fuel from the main fuel supply system is discharged into the intake passage upstream of the throttle valve via the main discharge nozzle, the discharged fuel collides with the surface of the throttle valve to form a liquid flow, and the fuel is thereafter changed into minute particles of fuel at the edge of the end of the throttle valve. Therefore, in the intake passage downsteam of the throttle valve, the variation in the amount of fuel fed from the main fuel supply system per unit time, namely, the variation of the air-fuel ratio per unit time, caused by the fuel fed from the main fuel supply system, is extremely small. However, since the fuel from the slow fuel supply system is directly discharged into the intake passage downstream of the throttle valve via the idle port and/or the slow port, the variation in the amount of fuel fed from the slow fuel supply system per unit time, in other words, the variation in the air-fuel ratio per unit time, caused by the fuel fed from the slow fuel supply system is very large. As a result, a surging operation corresponding to the change in the air-fuel ratio feedback control signal may occur.

SUMMARY OF THE INVENTION

It is the object of the present invention to provide an air-fuel ratio control apparatus whereby the surging phenomenon according to the air-fuel ratio control operation can be prevented from occurring, and the driving condition of the engine can thereby be improved.

According to the present invention, an air-fuel ratio control apparatus of an internal combustion engine which has an intake passage, a throttle valve disposed in the intake passage, a first fuel supply means for discharging fuel into the intake passage upstream of the throttle valve, which first fuel supply means supplies a first basic amount of fuel to the intake passage in accordance with the amount of air passing through the intake passage when the air-fuel ratio feedback control operation is not operating, a second fuel supply means for discharging fuel into the intake passage downstream of the throttle valve, which second fuel supply means supplies a second basic amount of fuel to the intake passage in accordance with the amount of air passing through the intake passage when the air-fuel ratio feedback control operation is not operating, and an exhaust passage comprises: an air-fuel ratio sensor disposed in the exhaust passage for generating an electrical signal indicating an air-fuel ratio condition of the engine; a deviation detecting means for generating an electrical air-fuel ratio signal indicating the deviation from a predetermined reference level of the level of the electrical signal fed from the air-fuel ratio sensor; a first control means connected to the deviation detecting means for controlling an amount of fuel discharged into the intake passage from the first fuel supply means in accordance with the air-fuel ratio signal; and a second control means connected to the deviation detecting means for controlling an amount of fuel discharged into the intake passage from the second fuel supply means in accordance with the air-fuel ratio signal, wherein the ratio of the change in the amount of fuel which is controlled by the second control means in accordance with the change in the air-fuel ratio signal to the second basic amount of fuel is smaller than the ratio of the change in the amount of fuel which is controlled by the first control means in accordance with the change in the air-fuel ratio signal to the first basic amount of fuel.

The above and other related objects and features of the present invention will be apparent from the following description of the present invention with reference to the accompanying drawings, as well as with reference to the appended claims.

DETAILED DESCRIPTION OF THE INVENTION

Figure 1:
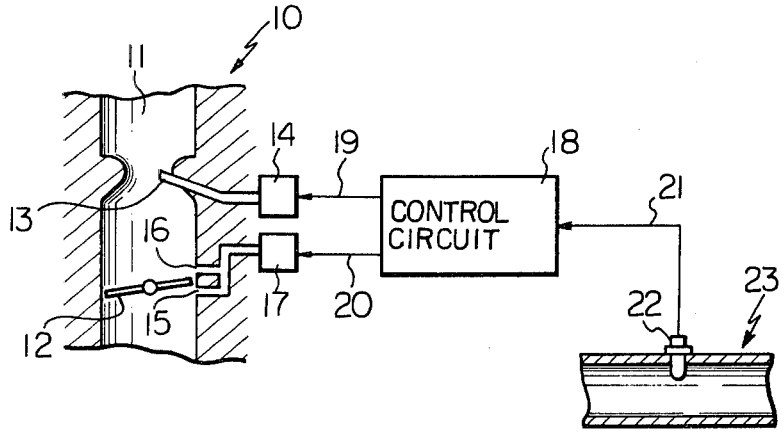
FIG. 1 is a schematic diagram of an embodiment of an air-fuel ratio control apparatus according to the present invention.

Referring to FIG. 1, an embodiment of an air-fuel ratio control apparatus according to this invention is schematically illustrated. Reference numeral 10 represents a carburetor of an internal combustion engine, and 11 an intake passage of the engine. A throttle valve 12 is located in the intake passage. A main discharge nozzle 13 is provided on a venturi located upstream of the throttle valve 12 in the intake passage 11. The amount of fuel discharged into the intake passage 11 from a main fuel supply system including the main discharge nozzle 13 is controlled by a first actuator 14 when the air-fuel ratio feedback control operation is being carried out. An idle port 15 is opened to the intake passage 11 at a position located downstream of the throttle valve 12. A slow port 16 is also opened to the intake passage 11 at a position located downstream of the throttle valve 12 when the opening degree of the throttle valve 12 exceeds a predetermined value. The amount of fuel discharged into the intake passage 11 from a slow fuel supply system including the idle port 15 and the slow port 16 is controlled by a second actuator 17 when the air-fuel ratio feedback control operation is being carried out. The actuators 14 and 17 may be on-off controlled electromagnetic valves for directly controlling the amount of fuel fed into the intake passage in response to the duration of pulse signals applied thereto from a control circuit 18 through lines 19 and 20, respectively, or may be on-off controlled electromagnetic valves for controlling the amount of air fed into respective air bleed chambers (not shown) where fuel is mixed with air to provide an emulsion, in response to the duration of pulse signals applied from the control circuit 18 through the lines 19 and 20, respectively, thereby to control the amount of fuel fed into the intake passage 11. In another embodiment, the actuators 14 and 17 may be electromagnetic valves of an analog type for controlling inner sectional areas of the fuel passages or inner sectional areas of the air bleed passages, respectively, in response to the level of respective voltage signals applied from power amplifying circuits which will be provided in the control circuit 18, in this case.

As is well-known, when the air-fuel ratio feedback control operation is not operating, the amount of fuel discharged into the intake passage 11 from the main fuel supply system and from the slow fuel supply system are respectively determined only by the amount of air passing through the intake passage 11. In this specification, this amount of fuel from the main fuel supply system is called "a main basic amount of fuel", and this amount of fuel from the slow fuel supply system is called "a slow basic amount of fuel."

An air-fuel ratio sensor 22 is located in an exhaust passage 23 of the engine. The air-fuel ratio sensor 22 may be a well-known oxygen concentration sensor for generating an output voltage of about 1 V when the engine is maintained on the rich side of stoichiometric conditions, and for generating an output voltage of about 0.1 to 0.2 V when the engine is maintained on the lean side of stoichiometric conditions. The detected signal from the air-fuel ratio sensor 22 is fed to the control circuit 18 via a line 21.

Figure 2:
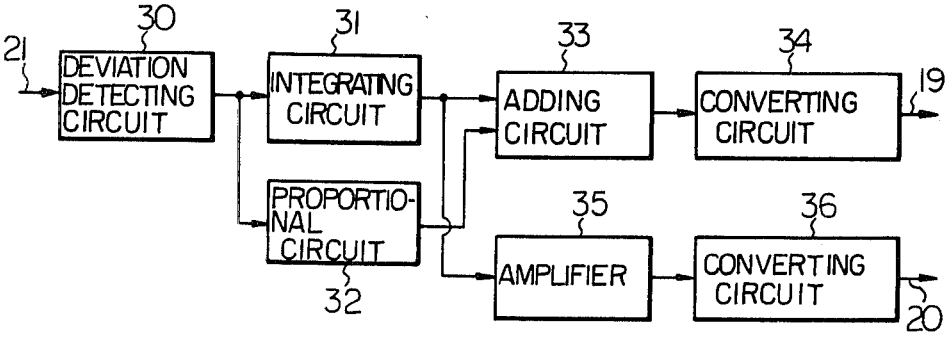
FIG. 2 is a block diagram of a preferred form of the control circuit illustrated in FIG. 1.
Figure 3:
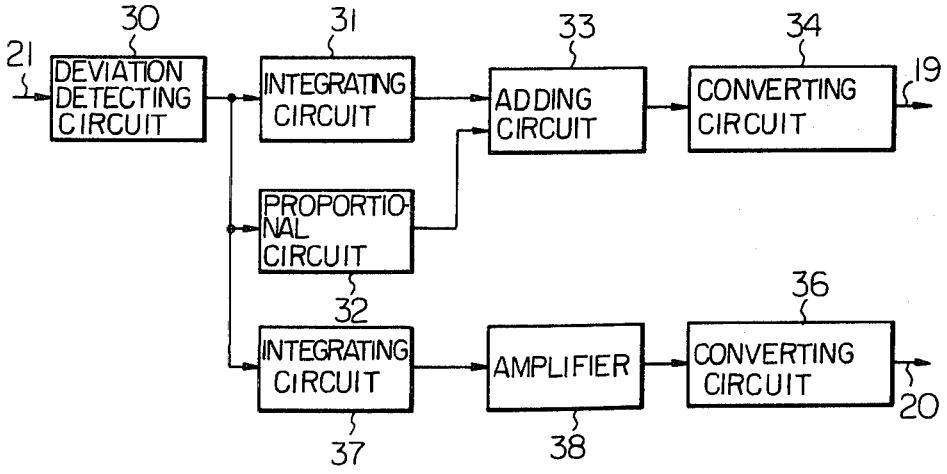
FIG. 3 is a block diagram of an alternative form of the control circuit illustrated in FIG. 1.
Figure 4:
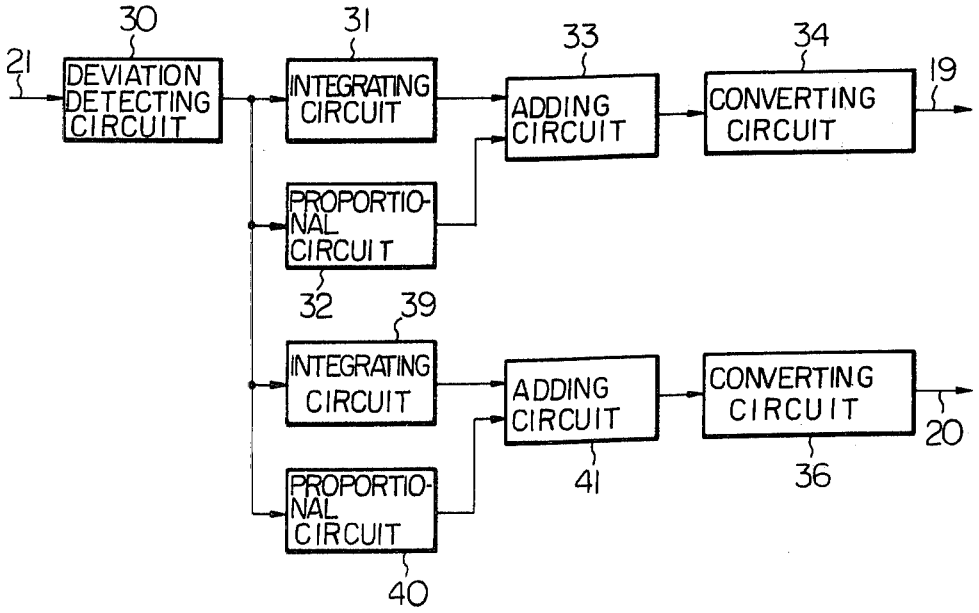
FIG. 4 is a block diagram of a further alternative form of the control circuit illustrated in FIG. 1.

FIGS. 2, 3 and 4 illustrate various modified constructions of the control circuit 18 shown in FIG. 1. In these figures, the same reference numerals as those in FIG. 1 are used with respect to circuits having the same construction and the function.

Figure 5:
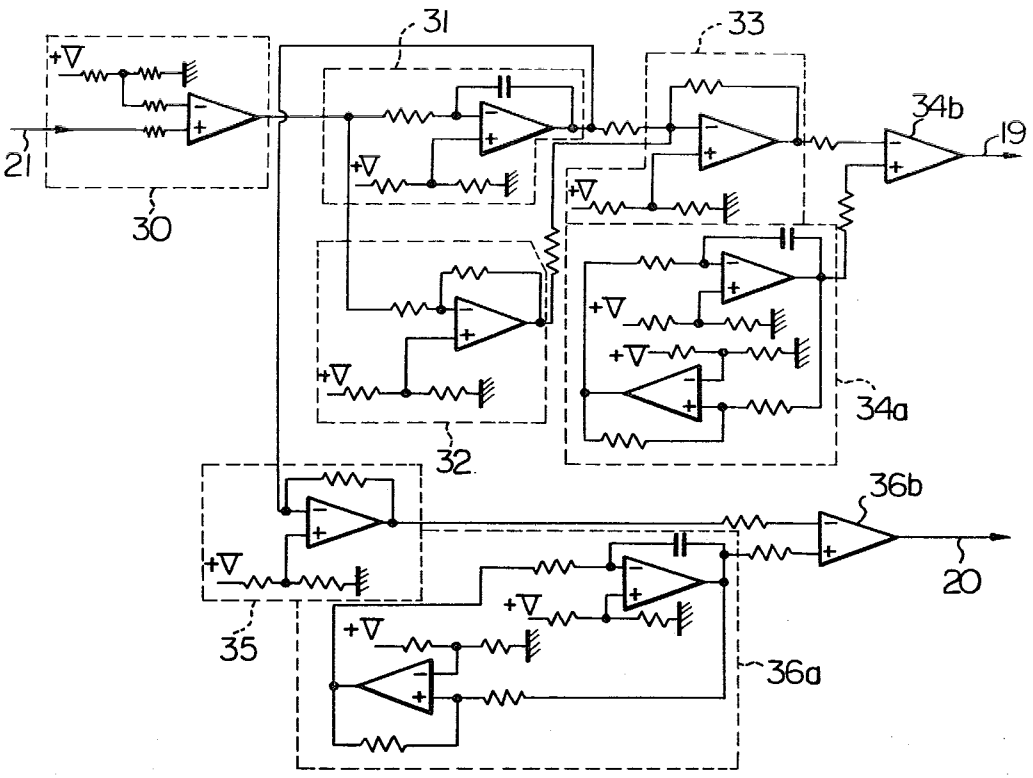
FIG. 5 is a detailed circuit diagram of the circuit of FIG. 2.

In the control circuit shown in FIG. 2, the detected signal fed from the air-fuel ratio sensor 22 via the line 21 is applied to a deviation detecting circuit 30. The level of the detected signal is compared in the deviation detecting circuit 30 with a predetermined reference voltage level. In this embodiment, the deviation detecting circuit 30 is a comparator using an operational amplifier, as shown in FIG. 5 illustrating a detailed circuit diagram of the control circuit of FIG. 2. The output signal (an air-fuel ratio signal) from the deviation detecting circuit 30, which signal has one of two discrete levels corresponding to the magnitude of the detected signal level in comparison with the reference voltage level, is applied to an integrating circuit 31 and to a proportional circuit 32.

The integrating circuit 31, which has a well-known circuit structure including an operational amplifier as shown in FIG. 5, generates an integration signal which is continuously variable with respect to time. The direction of variation of the level of the integration signal is determined by the level of the air-fuel ratio signal from the deviation detecting circuit 30. The proportional circuit 32, which has a well-known circuit structure of an inverting amplifier using an operational amplifier as shown in FIG. 5, generates a proportional signal which has a level proportional to the level of the air-fuel ratio signal fed from the deviation detecting circuit 30. The integration signal and the proportional signal are applied to an adding circuit 33 in which the levels of these applied signals are added to each other. This adding circuit 33 has a well-known circuit structure using an operational amplifier as shown in FIG. 5.

The added signal from the adding circuit 33 is applied to a converting circuit 34. The converting circuit 34 generates a pulse signal (a driving signal) having a duration which is proportional to the voltage level of the added signal fed from the adding circuit 33. In this embodiment, the converting circuit 34 is a triangular wave generating circuit **34*a* using two operational amplifiers (as shown in FIG. 5) and a comparator 34*b* having an operational amplifier (as also shown in FIG. 5) for comparing the level of the added signal with the level of the output signal from the triangular wave generating circuit 34*a*. The pulse signal from the converting circuit 34 is applied to the actuator 14 via the line 19 for energizing the actuator 14 comprising an on-off controlled electromagnetic valve. Thereby the amount of fuel discharged from the main fuel supply system is controlled in accordance with the duration of the pulse signal from the converting circuit 34**.

The integration signal from the integrating circuit 31 is further applied to a converting circuit 36 via an amplifier 35 of a well-known structure as shown in FIG. 5. The construction and the function of the converting circuit 36 are the same as those of the converting circuit 34. The pulse signal from the converting circuit 36 is applied to the actuator 17 via the line 20 to energize the actuator 17 comprising an on-off controlled electromagnetic valve. The amount of fuel discharged from the slow fuel supply system is thereby controlled in accordance with the duration of the pulse signal fed from the converting circuit 36.

As mentioned hereinbefore, the amount of fuel discharged from the main fuel supply system is controlled in accordance with the level of the added signal indicating the sum of the levels of the integration signal from the integrating circuit 31 and the proportional signal from the proportional circuit 32, whereas the amount of fuel discharged from the slow fuel supply system is controlled in accordance with the level of the integration signal from the integrating circuit 31. Consequently, the ratio of the change in the amount of fuel controlled by the slow fuel supply system in accordance with the change in the level of the air-fuel ratio signal to the slow basic amount of fuel is smaller than the ratio of the change in the amount of fuel controlled by the main fuel supply system in accordance with the change in the level of the air-fuel ratio signal to the main basic-/amount of fuel. Therefore, the air-fuel ratio of the air fuel mixture fed into the cylinder is smoothly controlled. As a result, the surging phenomenon of the engine is effectively prevented from occurring.

The control circuit shown in FIG. 3 has the same circuit structure as that of the above-mentioned control circuit of FIG. 2 except that, in the embodiment of FIG. 3, an integrating circuit 37 for generating an integration signal used for controlling only the slow fuel supply system is provided independently of the integrating circuit 31 of the main fuel supply system. In the control circuit of FIG. 3, the air-fuel ratio signal from the deviation detecting circuit 30 is integrated by the integrating circuit 37, and then fed to the converting circuit 36 via an amplifier 38 having the same circuit structure as that of the amplifier 35 of FIG. 2.

The time constant of the integrating circuit 37 is selected to be larger than the time constant of the integrating circuit 31. Therefore, by using the control circuit of FIG. 3, the rate of change of the amount of fuel discharged from the slow fuel supply system corresponding to the change in the air-fuel ratio signal can be made more slowly than the rate of change obtained in the case where the control circuit of FIG. 2 is used. In other words, the control circuit of FIG. 3 can control the change in the amount of fuel discharged from the slow fuel supply system with respect to time more smoothly than in the case where the control circuit of FIG. 2 is used. As a result, by using the control circuit of FIG. 3 the surging phenomenon can be more effectively prevented from occurring.

The control circuit shown in FIG. 4 has two independent circuits having almost the same circuit structure for controlling the main fuel supply system and the slow fuel supply system, respectively. Namely, the control circuit of FIG. 4 has a circuit for the main fuel supply system composed of the integrating circuit 31, the proportional circuit 32, the adding circuit 33 and the converting circuit 34, and a circuit for the slow fuel supply system composed of an integrating circuit 39, a proportional circuit 40, an adding circuit 41 and the converting circuit 36. The construction and the function of these circuits are the same as those of the circuit for controlling the main fuel supply system of the control circuit of FIG. 2 as shown in FIG. 6 illustrating a detailed circuit diagram of the control circuit of FIG. 4.

Figure 6:
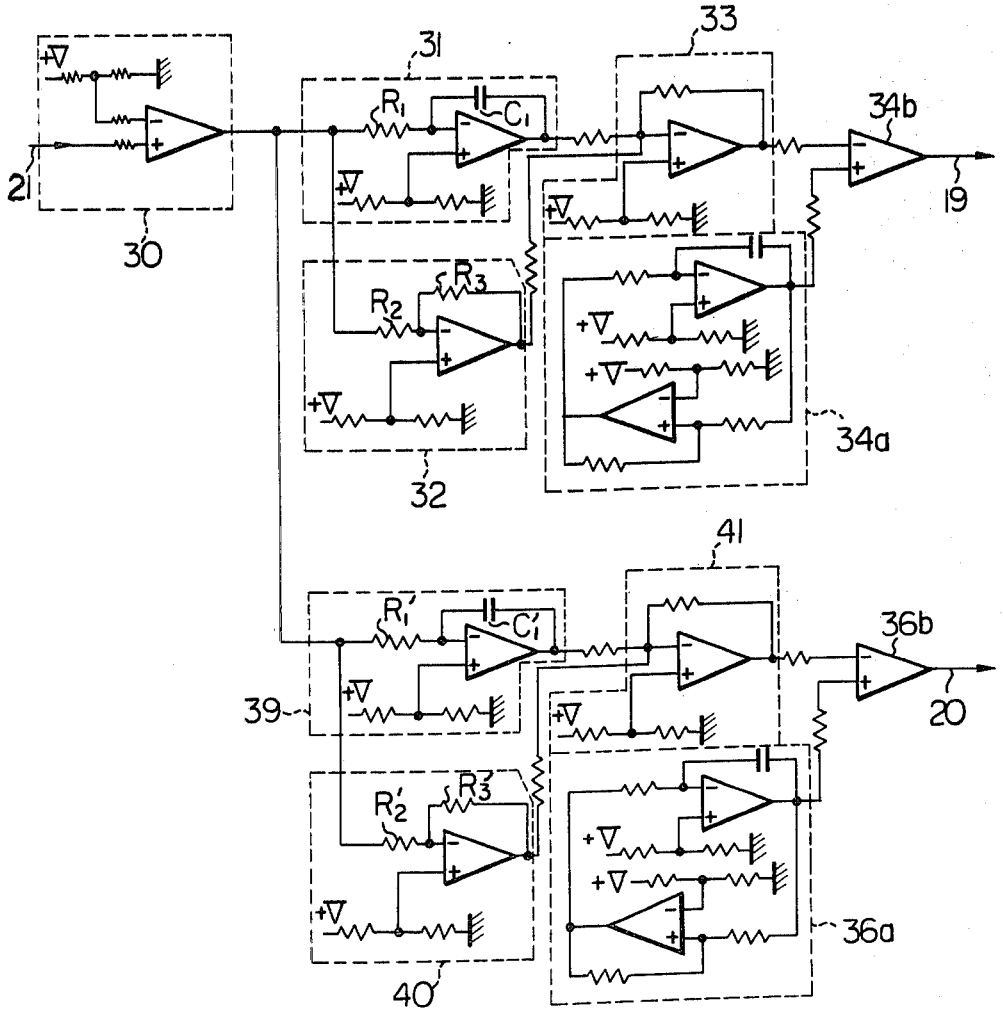
FIG. 6 is a detailed circuit diagram of the circuit of FIG. 4.

However, in the control circuit shown in FIGS. 4 and 6, the time constant of the integrating circuit 31 is different from that of the integrating circuit 39. In addition, the gain of the proportional circuit 32 is also different from that of the proportional circuit 40. Namely, the time constant of the integrating circuit 39 is selected to be larger than that of the integrating circuit 31; furthermore, the gain of the proportional circuit 40 is selected to be smaller than that of the proportional circuit 32. In this embodiment, since each of the integrating circuits 31 and 39 has a circuit structure comprising an operational amplifier, an input resistor, and a feedback capacitor, the resistance values $R_1$, $R_1'$ of the input resistors and the capacitance values $C_1$, $C_1'$ of the feedback capacitors are selected so as to satisfy the relationship of $R_1C_1 < R_1'C_1'$. Furthermore, in this embodiment, since each of the proportional circuits 32 and 40 has a circuit structure composed of an operational amplifier, an input resistor, and a feedback resistor, the resistance values $R_2$, $R_2'$ of the input resistors and the resistance values $R_3$, $R_3'$ of the feedback resistors are selected so as to satisfy the relationship of $(R_3/R_2) > (R_3'/R_2')$.

As a result, according to this embodiment, the change in the amount of fuel discharged from the slow fuel supply system is smoothly controlled with respect to time in accordance with the change in the amount of fuel from the main fuel supply system. Therefore, the air-fuel ratio of the air-fuel mixture fed into the cylinder is smoothly controlled; thus, the surging phenomenon of the engine is effectively prevented from occurring.

As will be apparent from the foregoing description, the air-fuel ratio control apparatus according to the present invention controls the amount of fuel discharged into the intake passage of the engine so that the ratio of the change in the amount of fuel from the slow fuel supply system in accordance with the change in the air-fuel ratio signal to the slow basic amount of fuel is smaller than the ratio of the change in the amount of fuel from the main fuel supply system in accordance with the change in the air-fuel ratio signal to the main basic amount of fuel. As a result, the air-fuel ratio of the air fuel mixture fed into the cylinder is smoothly controlled in response to the air-fuel ratio signal. As a result, the surging phenomenon of the engine can be effectively prevented from occurring. Therefore, the driving condition of the engine can be extremely improved.

As many widely different embodiments of the present invention may be constructed without departing from the spirit and scope of the present invention, it should be understood that the present invention is not limited to the specific embodiments described in this specification, except as defined in the appended claims.

What is claimed is:

1. In air-fuel ratio control apparatus for an internal combustion engine, the apparatus comprising: an intake passage, a throttle valve disposed in said intake passage, a first port opened to the intake passage at a position located upstream from said throttle valve, first fuel supply means for supplying fuel into said intake passage through said first port, said first fuel supply means supplying a first basic amount of fuel through said first port into said intake passage in accordance with the amount of air passing through said intake passage, an exhaust passage, a sensor disposed in said exhaust passage for generating an electrical air-fuel ratio signal, the level of which corresponds to the air-fuel ratio condition of said engine, and deviation detecting means responsive to said air-fuel ratio signal for generating an electrical air-fuel ratio difference signal indicating the deviation of the level of said electrical air-fuel ratio signal from a predetermined reference level:

first control means connected to said deviation detecting means for changing the amount of fuel supplied through said first port into said intake passage from said first fuel supply means in accordance with said air-fuel ratio difference signal, said first control means comprising:

an integrating circuit connected to said deviation detecting means for integrating said air-fuel ratio difference signal to generate an integration signal which is continuously variable with respect to time, the direction of variation of said integration signal being determined by the level of said air-fuel ratio difference signal, a proportional circuit connected to said deviation detecting means for generating a proportional signal having a level proportional to the level of said air-fuel ratio difference signal, an adding circuit for adding said integration signal and said proportional signal to generate an added signal, and first adjusting means comprising a first converting circuit connected to said adding circuit for generating a first driving signal having a duration corresponding to the level of said added signal, and a first electromagnetic valve energized by said first driving signal for controlling the amount of fuel supplied to said intake passage from said first fuel supply means, said amount of fuel being controlled in proportion to the level of said added signal;

a second port means opened to said intake passage at a position located upstream from said throttle valve when said throttle valve is fully closed and located downstream from said throttle valve when said throttle valve is opened;

second fuel supply means for supplying fuel through said second port means into said intake passage, said second fuel supply means supplying a second basic amount of fuel into said intake passage in accordance with the amount of air passing through said intake passage; and second control means connected to said deviation detecting means to be controlled thereby to change the amount of fuel supplied through said second port into said intake passage from said second fuel supply means in accordance with said air-fuel ratio different signal, the proportional change in the amount of fuel supplied through said second port from said second fuel supply means in response to the operation of said second control means, relative to said second basic amount of fuel, being smaller than the proportional change in the amount of fuel supplied through said first port from said first fuel supply means in response to the operation of said first control means, relative to said first basic amount of fuel, said second control means comprising second adjusting means connected to said integrating circuit of said first control means for adjusting the amount of fuel supplied to said intake passage from said second fuel supply means, said amount of fuel being controlled in proportion to the level of said integration signal, said second adjusting means comprising a second converting circuit for generating a second driving signal having a duration corresponding to the level of said integration signal from said first-named integrating circuit, and a second electromagnetic valve energized by said second driving signal from said second converting circuit for controlling the amount of fuel supplied to said intake passage from said second fuel supply means.

2. In air-fuel ratio control apparatus for an internal combustion engine, the apparatus comprising: an intake passage, a throttle valve disposed in said intake passage, a first port opened to the intake passage at a position located upstream from said throttle valve, first fuel supply means for supplying fuel into said intake passage through said first port, said first fuel supply means supplying a first basic amount of fuel through said first port into said intake passage in accordance with the amount of air passing through said intake passage, an exhaust passage, a sensor disposed in said exhaust passage for generating an electrical air-fuel ratio signal, the level of which corresponds to the air-fuel ratio condition of said engine, and deviation detecting means responsive to said air-fuel ratio signal for generating an electrical air-fuel ratio difference signal indicating the deviation of the level of said electrical air-fuel ratio signal from a predetermined reference level:

first control means connected to said deviation detecting means for changing the amount of fuel supplied through said first port into said intake passage from said first fuel supply means in accordance with said air-fuel ratio difference signal, said first control means comprising:

a first integrating circuit connected to said deviation detecting means for integrating said air-fuel ratio difference signal to generate an integration signal which is continuously variable with respect to time, the direction of variation of said integration signal being determined by the level of said air-fuel ratio difference signal, a proportional circuit connected to said deviation detecting means for generating a proportional signal having a level porportional to the level of said air-fuel ratio difference signal, an adding circuit for adding said integration signal and said proportional signal to generate an added signal, and first adjusting means connected to said adding circuit for adjusting the amount of fuel discharged into said intake passage from said first fuel supply means, said amount of fuel being controlled in proportional to the level of said added signal;

a second port means opened to said intake passage at a position located upstream from said throttle valve when said throttle valve is fully closed and located downstream from said throttle valve when said throttle valve is opened;

second fuel supply means for supplying fuel through said second port means into said intake passage, said second fuel supply means supplying a second basic amount of fuel into said intake passage in accordance with the amount of air passing through said intake passage; and second control means connected to said deviation detecting means to be controlled thereby to change the amount of fuel supplied through said second port into said intake passage from said second fuel supply means in accordance with said air-fuel ratio difference signal, the proportional change in the amount of fuel supplied through said second port from said second fuel supply means in response to the operation of said second control means, relative to said second basic amount of fuel, being smaller than the proportional change in the amount of fuel supplied through said first port from said first fuel supply means in response to the operation of said first control means, relative to said first basic amount of fuel, said second control means comprising:

a second integrating circuit connected to said deviation detecting means for integrating said air-fuel ratio difference signal to generate an additional integration signal which is continuously variable with respect to time, the direction of variation of said additional integration signal being determined by the level of said air-fuel ratio difference signal, the time constant of said second integrating circuit being larger than the time constant of said first-named integrating circuit, and second adjusting means connected to said second integrating circuit for adjusting the amount of fuel supplied to said intake passage from said second fuel supply means, said last-named amount of fuel being controlled in proportion to the level of said additional integration signal from said second integrating circuit.

3. The invention as claimed in claim 2 in which:

said first-named adjusting means comprises a first converting circuit connected to said first-named adding circuit for generating a first driving signal having a duration corresponding to the level of said added signal, and a first electromagnetic valve energized by said first driving signal for controlling the amount of fuel supplied into said intake passage from said first fuel supply means; and said second adjusting means comprises a second converting circuit for generating a second driving signal having a duration corresponding to the level of said integration signal from said second integrating circuit, and a second electromagnetic valve energized by said second driving signal for controlling the amount of fuel discharged into said intake passage from said second fuel supply means.

4. In air-fuel ratio control apparatus for an internal combustion engine, the apparatus comprising: an intake passage, a throttle valve disposed in said intake passage, a first port opened to the intake passage at a position located upstream from said throttle valve, first fuel supply means for supplying fuel into said intake passage through said first port, said first fuel supply means supplying a first basic amount of fuel through said first port into said intake passage in accordance with the amount of air passing through said intake passage, an exhaust passage, a sensor disposed in said exhaust passage for generating an electrical air-fuel ratio signal, the level of which corresponds to the air-fuel ratio condition of said engine, and deviation detecting means responsive to said air-fuel ratio signal for generating an electrical air-fuel ratio difference signal indicating the deviation of the level of said electrical air-fuel ratio signal from a predetermined reference level:

first control means connected to said deviation detecting means for changing the amount of fuel supplied through said first port into said intake passage from said first fuel supply means in accordance with said air-fuel ratio difference signal, said first control means comprising:

a first integrating circuit connected to said deviation detecting means for integrating said air-fuel ratio difference signal to generate an integration signal which is continuously variable with respect to time, the direction of variation of said integration signal being determined by the level of said air-fuel ratio difference signal, a proportional circuit connected to said deviation detecting means for generating a proportional signal having a level proportional to the level of said air-fuel ratio difference signal, an adding circuit for adding said integration signal and said proportional signal to generate an added signal, and adjusting means connected to said adding circuit for adjusting the amount of fuel discharged into said intake passage from said first fuel supply means, said amount of fuel being controlled in proportion to the level of said added signal;

a second port means opened to said intake passage at a position located upstream from said throttle valve when said throttle valve is fully closed and located downstream from said throttle valve when said throttle valve is opened;

second fuel supply means for supplying fuel through said second port means into said intake passage, said second fuel supply means supplying a second basic amount of fuel into said intake passage in accordance with the amount of air passing through said intake passage; and second control means connected to said deviation detecting means to be controlled thereby to change the amount of fuel supplied through said second port into said intake passage from said second fuel supply means in accordance with said air-fuel ratio difference signal, the proportional change in the amount of fuel supplied through said second port from said second fuel supply means in response to the operation of said second control means, relative to said second basic amount of fuel, being smaller than the proportional change in the amount of fuel supplied through said first port from said first fuel supply means in response to the operation of said first control means, relative to said first basic amount of fuel, said second control means comprising:

a second integrating circuit connected to said deviation detecting means for integrating said air-fuel ratio signal to generate an additional integration signal which is continuously variable with respect to time, the direction of variation of said additional integration signal being determined by the level of said air-fuel ratio difference signal, the time constant of said second integrating circuit being larger than the time constant of said first-named integrating circuit, a second proportional circuit connected to said deviation detecting means for generating a second proportional signal having a level proportional to the level of said air-fuel ratio difference signal, the proportion factor of said second proportional circuit being smaller than the proportion factor of said first-named proportional circuit, a second adding circuit for adding said additional integration signal and said second proportional signal to generate an additional added signal, and a second adjusting means connected to said second adding circuit for adjusting the amount of fuel discharged into said intake passage from said second fuel supply means, said amount of fuel being controlled in proportion to the level of said additional added signal.

5. The invention as claimed in claim 4 in which:

said first-named adjusting means comprises a first converting circuit connected to said first-named adding circuit for generating a first driving signal having a duration corresponding to the level of said added signal, and a first electromagnetic valve energized by said first driving signal for controlling the amount of fuel discharged into said intake passage from said first fuel means; and said second adjusting means comprises a second converting circuit for generating a second driving signal having a duration corresponding to the level of said additional added signal, and a second electromagnetic valve energized by said second driving signal for controlling the amount of fuel discharged into said intake passage from said second fuel supply means.

* * * * *

UNITED STATES PATENT AND TRADEMARK OFFICE

CERTIFICATE OF CORRECTION

PATENT NO. : 4,306,523

DATED : December 22, 1981

INVENTOR(S) : Keisou Takeda

It is certified that error appears in the above—identified patent and that said Letters Patent is hereby corrected as shown below:

Col. 5, line 13, before "amount" delete -- / --.

Col. 5, line 12, after "basic" delete -- - --.

Col. 7, line 40, change "different" to --difference--.

Signed and Sealed this

*Sixth* Day of *April 1982*

[SEAL]

*Attest:*

GERALD J. MOSSINGHOFF

*Attesting Officer*

*Commissioner of Patents and Trademarks*